US010513930B2

(12) United States Patent
Roche

(10) Patent No.: US 10,513,930 B2
(45) Date of Patent: Dec. 24, 2019

(54) SYSTEMS AND METHODS FOR PRE-STRESSING BLADES

(71) Applicant: UNITED TECHNOLOGIES CORPORATION, Farmington, CT (US)

(72) Inventor: Charles H. Roche, Tolland, CT (US)

(73) Assignee: UNITED TECHNOLOGIES CORPORATION, Farmington, CT (US)

( * ) Notice: Subject to any disclaimer, the term of this patent is extended or adjusted under 35 U.S.C. 154(b) by 0 days.

(21) Appl. No.: 14/707,781

(22) Filed: May 8, 2015

(65) Prior Publication Data

US 2015/0345299 A1 Dec. 3, 2015

Related U.S. Application Data

(60) Provisional application No. 62/007,252, filed on Jun. 3, 2014.

(51) Int. Cl.
*F01D 5/14* (2006.01)
*F01D 5/18* (2006.01)

(52) U.S. Cl.
CPC ..... *F01D 5/147* (2013.01); *F01D 5/18* (2013.01); *F05D 2220/32* (2013.01); *F05D 2260/94* (2013.01); *Y10T 29/38* (2015.01); *Y10T 29/49337* (2015.01); *Y10T 29/49341* (2015.01)

(58) Field of Classification Search
CPC ..... F01D 5/147; F01D 5/005; F01D 25/285; F01D 5/286; F01D 5/18; F05D 2260/83; F05D 2270/114; F05D 2260/12; F05D 2220/32; F05D 2260/94; Y10T 29/38; Y10T 29/49337; Y10T 29/49341
See application file for complete search history.

(56) References Cited

U.S. PATENT DOCUMENTS

| | | | | |
|---|---|---|---|---|
| 2,438,866 A | | 3/1948 | Rockwell et al. | |
| 4,411,715 A | | 10/1983 | Brisken et al. | |
| 5,158,435 A | * | 10/1992 | Eardley | C21D 7/02 29/889.2 |
| 2010/0014982 A1 | * | 1/2010 | Haje | F01D 5/282 416/241 R |

(Continued)

FOREIGN PATENT DOCUMENTS

| | | | |
|---|---|---|---|
| DE | 102011079254 | A1 | 10/2012 |
| EP | 1662092 | A2 | 5/2006 |

OTHER PUBLICATIONS

European Search Report for EP Application No. 15 17 0353.

(Continued)

*Primary Examiner* — John C Hong
(74) *Attorney, Agent, or Firm* — Cantor Colburn LLP

(57) ABSTRACT

A system and methods are provided for pre-stressing blade elements for a gas turbine engine. In one embodiment, a method includes rotating a blade element relative to an axis. The method may also include controlling rotational speed of the blade element to generate residual stress in the blade element. The method may also include rotating multiple blade elements and fan blade units to generate residual stress. Blade elements may be rotated to exceed a maximum operating speed of the blade element to 120% of the maximum operating speed of the blade element.

19 Claims, 5 Drawing Sheets

(56) References Cited

U.S. PATENT DOCUMENTS

2014/0137407 A1* 5/2014 Staroselsky ..... B23P 6/002
29/889.1

OTHER PUBLICATIONS

DE102011079254 English Translation for Abstract.
EP Office Action for Application No. 15 170 353.5; dated Mar. 6, 2019.
EP Office Action for Application No. 15 170 353.5; dated Sep. 18, 2019.

* cited by examiner

SYSTEMS AND METHODS FOR PRE-STRESSING BLADES

CROSS-REFERENCE TO RELATED APPLICATIONS

This application claims priority to U.S. Provisional Application No. 62/007,252 filed on Jun. 3, 2014 and titled SYSTEMS AND METHODS FOR PRE-STRESSING BLADES, the disclosure of which is hereby incorporated by reference in its entirety.

FIELD

The present disclosure relates generally to systems and methods for pre-stressing components of a gas turbine engine.

BACKGROUND

Gas turbine engine components are susceptible to damage due to foreign objects and fatigue caused by prolonged operational use, which can lead to cracks and other forms of wear. Such damage can limit the component's operational life and increase its maintenance time and cost. While increasing a component's thickness or peening its surface to harden it are successful methodologies used in the art to increase its operational life, there continues to be a need for improved systems and methodologies which increase the component's operational life while minimizing cost, manufacturing time, and any adverse effects on aerodynamic performance.

SUMMARY

Disclosed and claimed herein are systems and methods for pre-stressing components for a gas turbine engine. In one embodiment, a method for pre-stressing a component for a gas turbine engine includes rotating the component relative to an axis and controlling rotational speed of the component to generate residual stress in the component.

In one embodiment, the component includes a blade element.

In one embodiment, the blade element is at least one of a fan blade, a compressor blade, a solid blade, a hollow blade and a shrouded blade.

In one embodiment, the axis is perpendicular to a central axis of the blade element.

In one embodiment, controlling rotational speed includes rotating the blade element to exceed a maximum operating speed of the blade element to 109.5% of the maximum operating speed.

In one embodiment, controlling rotational speed includes controlling rotation of the blade element to exceed a maximum operation speed of the blade element for a predetermined time period.

In one embodiment, the component includes a plurality of blade elements.

In one embodiment, the component includes a plurality of fan blade units.

In one embodiment, the residual stress includes residual compressive stress in one or more regions of the component.

Another embodiment is directed to a system for pre-stressing blade elements for a gas turbine engine including a rotation unit configured to rotate a blade element relative to an axis, and a control unit configured to control rotation speed of the blade element to generate residual stress in the blade element.

BRIEF DESCRIPTION OF THE DRAWINGS

The features, objects, and advantages of the present disclosure will become more apparent from the detailed description set forth below when taken in conjunction with the drawings in which like reference characters identify correspondingly throughout and wherein.

DETAILED DESCRIPTION OF THE EXEMPLARY EMBODIMENTS

Overview and Terminology

As used herein, the term 'blade element' refers to one or more fan blades, compressor blades, or other rotational blade elements which are solid, hollow, or shrouded.

As used herein, the term 'maximum operating speed' refers to a maximum rotational speed at which a blade element is designed to safely operate. This speed may be above speeds at which the blade actually operates in various applications. It is estimated or determined based on modeling or testing, and accounts for rotation speeds required during a blade's life in an engine. Gas turbine engines can employ high and low speed rotors where components, such as blades, are optimized structurally for their respective rotor. In addition, regulatory agencies (e.g., Federal Aviation Administration) may require blades to survive a worst case speed, or redline speed, such that the blades may be continuously operated up to the redline speed. The maximum operating speed may correlate to a redline speed for which a blade element is rated.

As used herein, the term 'pre-stressing' refers to applying loads to or stressing a structure before the structure is used or operated in its intended application.

As used herein, the terms "a" or "an" shall mean one or more than one. The term "plurality" shall mean two or more than two. The term "another" is defined as a second or more. The terms "including" and/or "having" are open ended (e.g., comprising). The term "or" as used herein is to be interpreted as inclusive or meaning any one or any combination. Therefore, "A, B or C" means "any of the following: A; B; C; A and B; A and C; B and C; A, B and C". An exception to this definition will occur only when a combination of elements, functions, steps or acts are in some way inherently mutually exclusive.

Reference throughout this document to "one embodiment," "certain embodiments," "an embodiment," or similar term means that a particular feature, structure, or characteristic described in connection with the embodiment is included in at least one embodiment. Thus, the appearances of such phrases in various places throughout this specification are not necessarily all referring to the same embodiment. Furthermore, the particular features, structures, or characteristics may be combined in any suitable manner on one or more embodiments without limitation.

Figure 1:
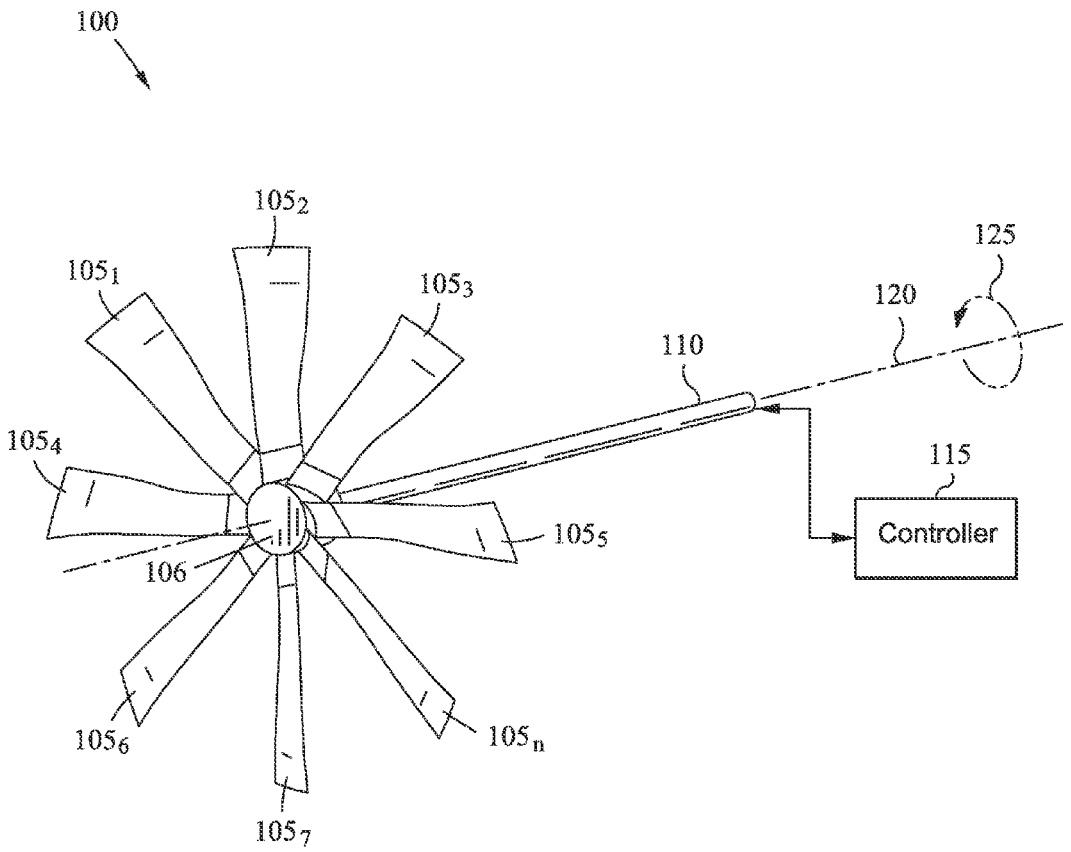
FIG. 1 depicts a system diagram according to one or more embodiments.
Figure 2:
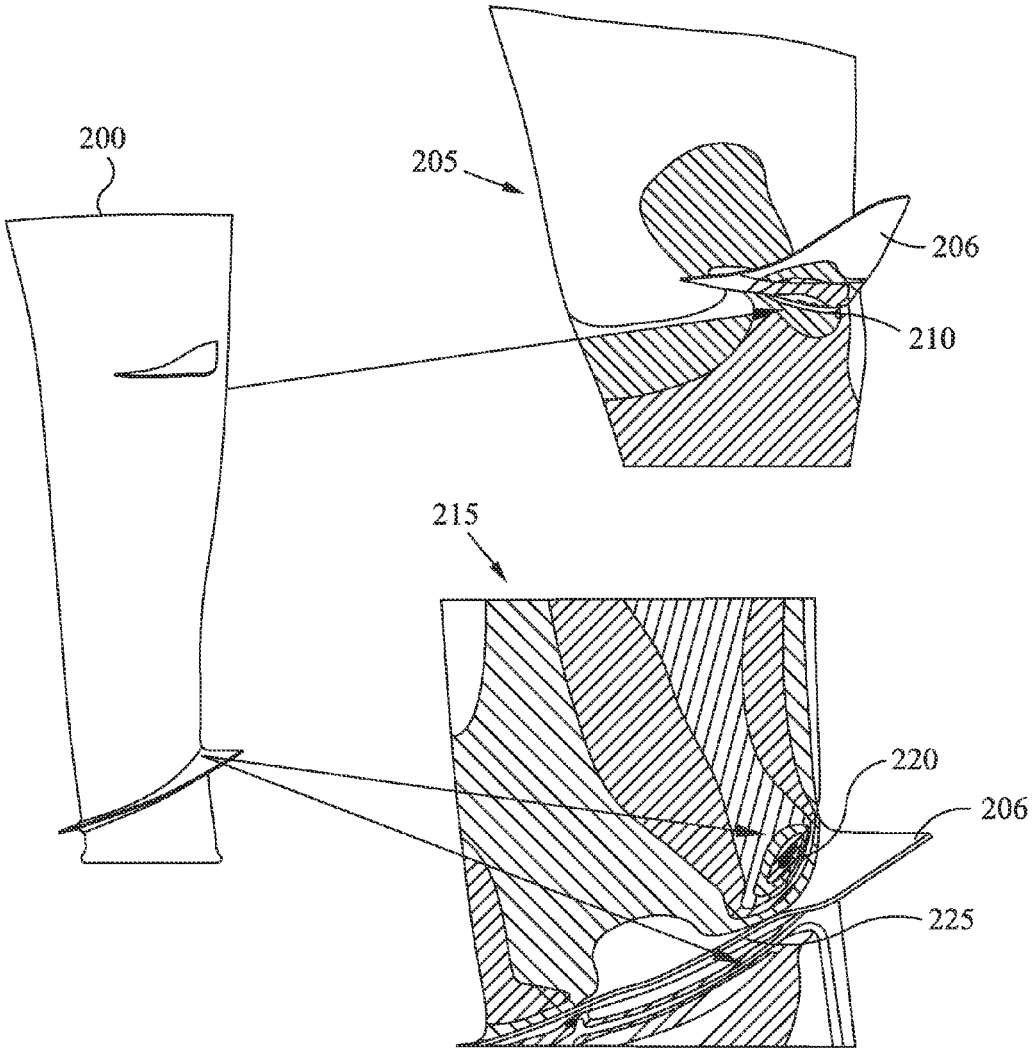
FIG. 2 depicts a graphical representation of residual stress regions in a gas turbine engine component according to one or more embodiments.

Referring now to FIGS. 1 and 2, a system 100 includes one or more blade elements $\mathbf{105}_{1\text{-}n}$, mechanically coupled to a rotation unit 106 and a shaft 110, and operatively associated with a controller 115 configured to rotate blade elements $\mathbf{105}_{1\text{-}n}$, relative to axis 120 in a direction 125 to generate residual stress therein. As shown in FIG. 2, an exemplary blade element 200, which can include shrouds 206, includes a general region 205 having a high stress area 210, and a general region 215 having high stress areas 220, 225. These high stress areas (210, 220, 225) are portions of blade element 200 which encounter particularly high stress during operation in an engine, and thus are exemplary regions which may be targeted for pre-stressing in order to increase durability and longevity of blade element 210.

Figure 3:
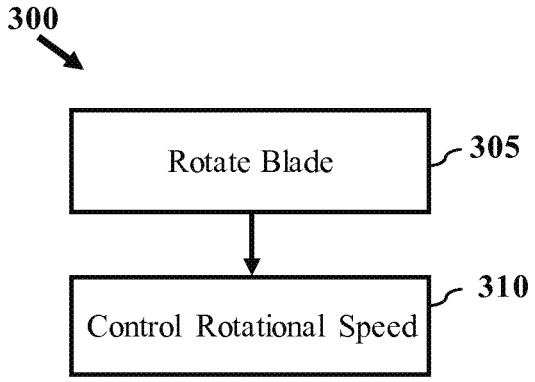
FIG. 3 depicts a process for pre-stressing blade elements according to one or more embodiments.

Referring to FIG. 3, a method 300 pre-stresses blade elements $\mathbf{105}_{1\text{-}n}$ using exemplary system 100. At block 305, controller 115 initiates rotation of blade elements $\mathbf{105}_{1\text{-}n}$, on shaft 110 about axis 120. At block 310, controller 115 increases rotational speed of blade elements $\mathbf{105}_{1\text{-}n}$ beyond a maximum operating speed of the blade elements. For example, if blade elements are designed for rotation speeds within the range of 3,000 rpm or 12,000 rpm during operation in an engine, then controller 115 may be configured to increase their rotational speed about axis 120 to a rotational speed that is 109.5% of the maximum operating speed to generate a 20% increase in stress at block 310. Controller 115 may be configured to increase the rotational speed up to 120%, such as an increase of 118.3% to generate a 40% increase in steady stress. Such rotational overspeeding pre-stresses the blade elements $\mathbf{105}_{1\text{-}n}$ and generates residual stress in at least high stress areas (210, 220, 225) thereof. The residual stress from process 300 can include tensile and/or compressive stress which remains in the material of the blade element 200. The residual stress results from stresses induced within the blade element 200 above its yield stress (e.g., at or above the minimum level of stress required to structurally change the blade element 200) during controlled rotational overspeeding thereof.

It will be appreciated that such structural changes of blade elements $\mathbf{105}_{1\text{-}n}$ caused by rotating the blade elements at speeds above their yield stress include permanent deformations in one or more areas (e.g., areas 210, 220, 225). It will also be appreciated that inducing residual stress in a blade element can be beneficial by increasing the blade element's durability or operational life to, for example, one or more years more than conventional blades. The maximum rotational speed utilized at block 310 can be controlled up to the ductile limit of the blade elements $\mathbf{105}_{1\text{-}n}$.

Figure 4:
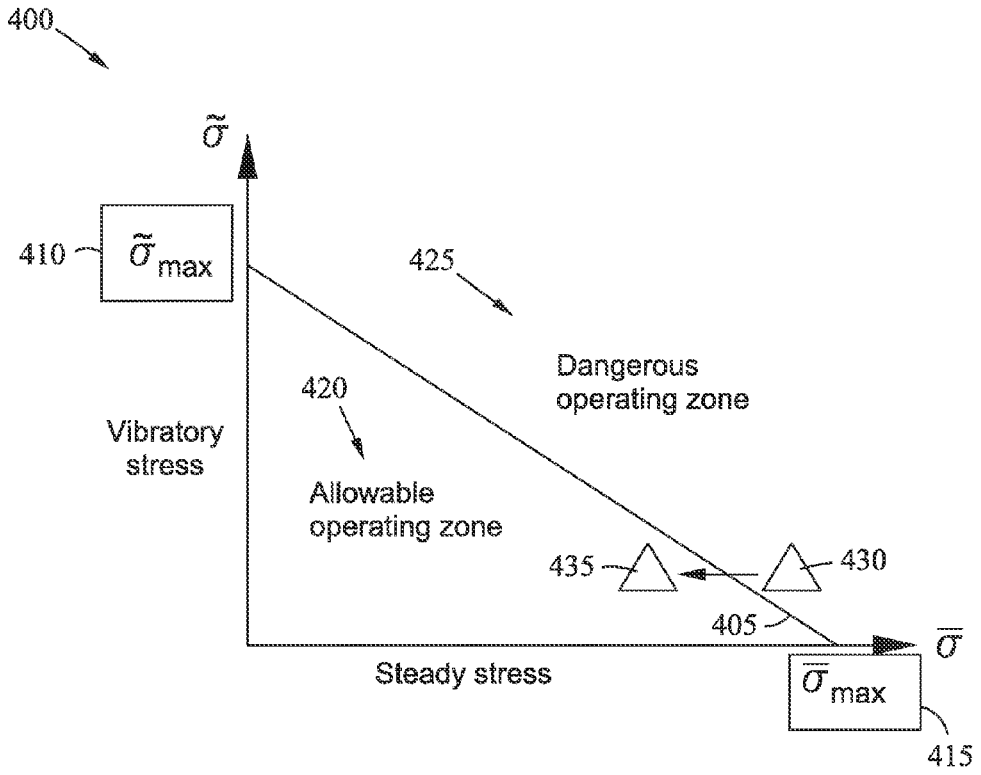
FIG. 4 depicts a graphical representation of operating zones for a component with respect to vibratory and steady stress on the component according to one or more embodiments.

Referring to FIG. 4, chart 400 depicts a graphical representation of operating zones for a blade element relative to vibratory and steady stress limits, such as maximum vibratory stress 410, maximum steady stress 415, allowable operating zone 420 and dangerous operating zone 425. In addition, chart 400 is an exemplary representation of a Goodman diagram for a blade element (e.g., blade elements $\mathbf{105}_{1\text{-}n}$), or blade units. Maximum vibratory stress 410 refers to the endurance limit or endurance strength of a blade element. Maximum steady stress 415 refers to the yield strength or ultimate strength of a material. Maximum vibratory stress 410 and maximum steady stress 415 can be determined by modeling and/or test data to account for one or more of temperature, pressure, material of the blade and blade type, where line 405 represents the boundary between allowable operating zone 420 and dangerous operating zone 425. Line 405, which may be a curve, is relative to vibratory stress (e.g., vibrating part of load due to engine imbalance, air smoothness, etc.) and steady stress (e.g., stress due to centrifugal loads during rotation, air loads, etc.).

Pre-stressing may include rotation of a blade element above a maximum operating speed for the blade element (e.g., outside of allowable operating zone 420), wherein rotationally induced steady stress is increased. Triangle 430 represents an exemplary region (e.g., regions 210, 220 and 225) of a blade element prior to pre-stressing. Residual compressive stress induced in the region or blade element during pre-stressing can shifts triangle 430 into allowable operating zone 420 which is represented by triangle 435. The shift in diagram 400 from triangle 430 to triangle 435 represents a horizontal shift and induced generation of residual compressive stress. This horizontal shift can indicate that durability of a blade element is improved with respect to steady state stress. It may be appreciated that different portions of a blade element may fall into different areas of allowable operating zones. According to one embodiment, pre-stressing can allow for conversion of blade regions into allowable operating zone 420 and/or allow for regions within allowable operating zone 420 to shift further away from line 405, or within operating zone 420, as a result of pre-stressing.

Figure 5:
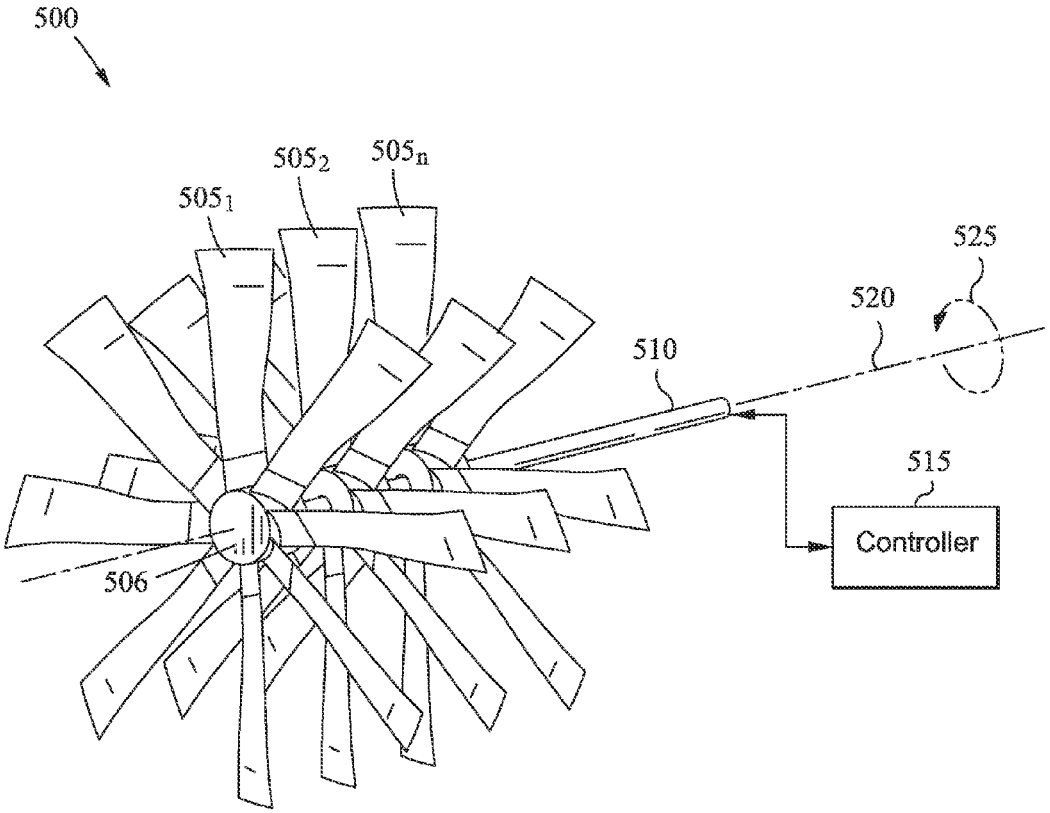
FIG. 5 depicts a system diagram according to one or more embodiments.

Referring to FIG. 5, a system 500 includes a plurality of blade units $\mathbf{505}_{1\text{-}n}$ (e.g., a plurality of sets of blade elements) mounted to rotation unit 506 and shaft 510. System 500 may be configured to rotate blade units $\mathbf{505}_{1\text{-}n}$ based on control output from controller 515. In certain embodiments, system 500 may include an overspeed rig for rotating the blade units $\mathbf{505}_{1\text{-}n}$ as shown by direction 525 relative to axis 520, which is perpendicular to a central axis of blade units $\mathbf{505}_{1\text{-}n}$. System 500 can rotate multiple blades and blade units to pre-stress multiple blade units as described above at the same time.

It will be appreciated that the above described systems and methods may utilize different rotation speeds and time periods depending on the specific application. For example, in accordance with certain embodiments, the maximum rotational speed utilized at block 310 is 109.5% of the blade element's maximum operating speed, which generates a 20% increase in stress. In other embodiments, the maximum rotational speed utilized at block 310 is 120% of the blade element's maximum operating speed. In yet other embodiments, the maximum rotational speed utilized at block 310 is between 100%-120% of the blade element's maximum operating speed.

In accordance with certain embodiments, the temperature and pressure of the atmosphere in which pre-stressing will take place can be measured to determine the rotation speeds and time periods used. By way of example, pre-stressing blade elements in a spin pit having a lower pressure and/or modified temperature can affect the required speed and time period needed to accomplish a given level of pre-stressing on the blade elements. Blade elements may be pre-stressed in a vacuum or a partial vacuum such that a reduction in air at the pre-stressing location requires less air to circulate/pump, which in turn provides less stress on the rotational unit. System 100 and/or process 300 may be configured to reduce the pressure to a pure vacuum or very low pressure during pre-stressing of blade elements $\mathbf{105}_{1\text{-}n}$, such that less energy is required to rotate the blade elements.

In accordance with certain embodiments, the rotational speed of the blade elements at block 310 may exceed their maximum operating speed for a predetermined time period within the range of, for example, 1-30 seconds. The predetermined rotational time period at overspeed depends on the material and/or ductility of the blade elements. By way of example, titanium blade elements may be rotated with controlled overspeed for 1 second to establish residual stress. In certain embodiments, overspeeding may be performed for 0.25 seconds to 30 seconds. Other time periods can alternatively or additionally be utilized.

Pre-stressing the blade elements as described herein can cause twisting thereof such that residual compressive stress generated therein counteracts one or more operational forces during use in an engine, whereby such over twisting corrects for twisting during engine use. It will be appreciated that the characteristics of a blade at sea level or at low temperatures may vary greatly relative to the characteristics of the blade at flight altitude and while at operating temperatures.

Although the systems and methods of the present disclosure are described as being used with one or more blade elements, it will be appreciated that the principles described herein can apply to other components, such vane elements, non-gas turbine engine components, and rotating elements in general.

While this disclosure has been particularly shown and described with references to exemplary embodiments thereof, it will be understood by those skilled in the art that various changes in form and details may be made therein without departing from the scope of the claimed embodiments.

What is claimed is:

1. A method for pre-stressing a compressor blade or a fan blade of a gas turbine engine, the method comprising:

pre-stressing the compressor blade or the fan blade by rotating the compressor blade or the fan blade relative to an axis; and controlling rotational speed of the compressor blade or the fan blade to generate residual stress in the compressor blade or the fan blade, wherein the pre-stressing applies loads to or stresses to the compressor blade or the fan blade before the compressor blade or the fan blade is used or operated in an intended application.

2. The method of claim 1, wherein the compressor blade or the fan blade is hollow and/or a shrouded blade.

3. The method of claim 1, wherein the axis is perpendicular to a central axis of the compressor blade or the fan blade.

4. The method of claim 1, wherein controlling rotational speed includes rotating the compressor blade or the fan blade to exceed a maximum operating speed of the compressor blade or the fan blade to 109.5% of the maximum operating speed.

5. The method of claim 1, wherein controlling rotational speed includes controlling rotation of the compressor blade or the fan blade to exceed a maximum operation speed of the compressor blade or the fan blade for a predetermined time period.

6. The method of claim 1, wherein the compressor blade or the fan blade is a plurality of compressor blades or a plurality of fan blades.

7. The method of claim 1, wherein the residual stress includes residual compressive stress in one or more regions of the compressor blade or the fan blade.

8. The method as in claim 1, wherein the compressor blade or the fan blade is formed from titanium.

9. A method for pre-stressing compressor blades or fan blades of a gas turbine engine, the method comprising:

pre-stressing the compressor blades or the fan blades by rotating the compressor blades or the fan blades relative to an axis; and controlling rotational speed of the compressor blades or the fan blades to generate residual stress in the compressor blades or the fan blades, wherein the compressor blades or the fan blades are located on a plurality of fan blade units, and the pre-stressing applies loads to or stresses to the compressor blades or the fan blades before the compressor blades or the fan blades are used or operated in an intended application.

10. The method as in claim 9, wherein the compressor blades or the fan blades are formed from titanium.

11. A system for pre-stressing compressor blades or fan blades of a gas turbine engine, the system comprising:

a rotation unit configured to rotate and pre-stress a compressor blade or a fan blade relative to an axis; and a control unit configured to control rotation speed of the compressor blade or the fan blade to generate residual stress in the compressor blade or the fan blade, wherein pre-stress of the compressor blade or the fan blade applies loads to or stresses to the compressor blade or the fan blade before the compressor blade or the fan blade is used or operated in an intended application.

12. The system of claim 11, wherein the compressor blade or the fan blade is hollow blade and/or a shrouded blade.

13. The system of claim 11, wherein the axis is perpendicular to a central axis of the compressor blade or the fan blade.

14. The system of claim 11, wherein controlling rotational speed includes rotating the compressor blade or the fan blade to exceed a maximum operating speed of the compressor blade or the fan blade to 109.5% of the maximum operating speed.

15. The system of claim 11, wherein controlling rotation speed includes controlling rotation of the compressor blade or the fan blade to exceed a maximum operational speed for a predetermined time period.

16. The system of claim 11, wherein the compressor blade or the fan blade is a plurality of compressor blades or a plurality of fan blades mounted to the rotation unit.

17. The system of claim 11, wherein of the compressor blade or the fan blade is a plurality of fan blade units.

18. The system of claim 11, wherein the residual stress includes residual compressive stress in one or more regions of the compressor blade or the fan blade.

19. The system as in claim 11, wherein the compressor blades or the fan blades are formed from titanium.

* * * * *